United States Patent [19]

Doi et al.

[11] 4,137,106

[45] Jan. 30, 1979

[54] SUPER HARD METAL ROLL ASSEMBLY AND PRODUCTION THEREOF

[75] Inventors: Yoshihiko Doi; Yasuhiro Saito; Mitsunori Kobayashi; Seiki Hiraoka, all of Itami, Japan

[73] Assignee: Sumitomo Electric Industries, Ltd., Osaka, Japan

[21] Appl. No.: 708,759

[22] Filed: Jul. 26, 1976

[51] Int. Cl.[2] ..... B22F 7/02

[52] U.S. Cl. ..... 148/126; 29/132; 29/420.5; 75/203; 75/204; 75/208 R; 428/565; 228/131

[58] Field of Search ..... 75/203, 204, 208 R, 75/200; 428/545, 564, 565, 552; 29/132, 129.5, 420.5; 228/127, 128, 131; 148/126

[56] References Cited

U.S. PATENT DOCUMENTS

| | | | |
|---|---|---|---|
| 2,313,227 | 3/1943 | De Bats | 75/208 R |
| 2,652,520 | 9/1953 | Studders | 75/208 R |
| 2,913,819 | 11/1959 | Andreotti et al. | 75/208 R |
| 3,609,849 | 10/1971 | Krol | 29/132 |

OTHER PUBLICATIONS

Schwarzkopf, P., et al., Cemented Carbides, pp. 38–39, 84–85, 1960, MacMillan, N.Y.

*Primary Examiner*—Richard E. Schafer
*Attorney, Agent, or Firm*—Wenderoth, Lind & Ponack

[57] ABSTRACT

A super hard metal roll assembly and a process for producing it are disclosed. Initially, a powdered mix of super hard metal materials is moulded into a hollow cylindrical moulding. The moulding is then fitted about a super hard metal cylindrical element such as roll, cylinder, pillar or shaft, and sintered to contract to a bushing tightly engaging the outer periphery of the cylindrical element to produce a super hard metal roll assembly. The roll assembly may be further treated in a high temperature and high pressure inert gas in order to eliminate voids at the interface between the bushing and the cylindrical element.

5 Claims, 7 Drawing Figures

SUPER HARD METAL ROLL ASSEMBLY AND PRODUCTION THEREOF

The present invention relates to a super hard metal roll assembly and production thereof.

As is known, a super hard metal or cemented carbide is produced by sintering a powdered mix of tungsten carbide, cobalt and the like, the resources of which are limited on the earth. When a super hard metal is used as a machining tool, a system as a whole including the tool and its jig requires both high compression strength and toughness. On the other hand, the effective portion of the tool for machining a workpiece is ordinarily limited to a small surface area thereof. Therefore, by grinding off the deformed and damaged area, the tool is reproduced for successive use. For example, an original roll with a diameter of 150 mm is ordinarily ground by about 1 mm per radius after one cycle of use, and when the diameter becomes 140 mm after five cycles of uses and grindings, the roll is used and then scrapped. Apparently, this is a waste of resource.

In order to form a super hard metal layer integrally about a super hard metal roll, cylinder, pillar, shaft or the like which was worn away, or in order to integrally combine an outer layer with an inner member having a different composition from the former, there is a conventional method in which the outer layer of sintered super hard metal is fitted about the inner member and is integrated by applying a high pressure to the outer member at a higher or lower temperature than a sintering point.

According to this conventional method, however, the outer super hard metal should be fitted about the inner metal with high precision. As a result, not only is the cost expensive, but also troublesome work is needed for machining the metals. Thereafter the assembly should be treated at a high temperature under a heavy pressure, and a specific apparatus such as a hot press machine or a hot and static press machine is required, resulting in a higher production cost.

On the hand, when the metals are brazed together, although the process may be ready and inexpensive, it has a disadvantage in that the brazed portion is weak and easily disengaged.

A primary object of the invention is to obviate the above defects, and to provide a super hard metal roll assembly having a super hard metal bushing securely and tightly engaged with a roll, shaft or the like.

A further object of the invention is to provide a process for producing a super hard metal roll assembly by utilizing a contraction force upon sintering a moulding formed with powdered super hard metal materials or upon sintering a pre-sintered moulding, fitted about a roll or the like.

Other objects and features of the invention will be apparent from the following description of the invention with reference to the accompanying drawings, in which.

Throughout the drawings, similar parts and elements are shown by the similar reference numerals.

Figure 1:
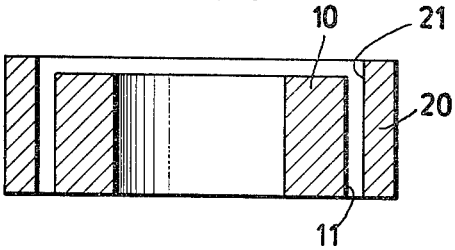
FIGS. 1 and 2 are sectional views showing a first embodiment of a process for producing a roll assembly according to the invention.
Figure 2:
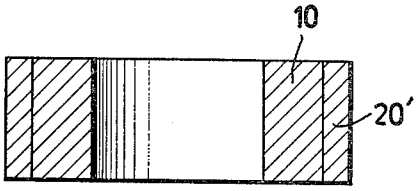

Referring now to FIGS. 1 and 2, the numeral 10 is a cylindrical element such as roll, cylinder, pillar or shaft made of super hard metal, around which is to be securely and tightly mounted a bushing 20' of super hard metal.

Initially, a powdered mix of super hard metal materials is moulded into a moulding 20 having an inner periphery 21 substantially complementary to the shape of an outer periphery 11 of the cylindrical element 10, preferably under a pressure of 10 kg/cm$^2$ to 10,000 kg/cm$^2$ at room temperature. When the pressure is less than 10 kg/cm$^2$, the obtained moulding has a poor strength and may readily be cracked, while if more than 10,000 kg/cm$^2$ of pressure is applied, the die or press machine is rapidly worn out. The period for holding the highest pressure depends on the dimensions of the moulding, but preferably is about 10 to 10,000 seconds.

Said powdered mix may consist of 50 to 99.9% by weight of hard metal carbide particles such as tungsten carbide, titanium carbide, tantalum carbide, niobium carbide, molybdenum carbide, chromium carbide, hafnium carbide or vanadium carbide, with the remainder of the mix being a binder metal such as iron, nickel, cobalt, chromium, copper, silver or gold. As is known to the art, more than one sort of metal carbide and one sort of binder metal can be mixed.

Said moulding 20, if desired, can be pre-sintered at a temperature ranging from 200° to 1,000° C. Thereafter the pre-sintered moulding can be further machined into a desired shape. However, when the moulding has been pre-sintered below 200° C., it is easily broken upon machining, while if the temperature exceeds 1,000° C., the pre-sintered moulding is too hard for machining. Moreover, careful attention should be given to avoiding oxidation upon pre-sintering, and therefore pre-sintering should be done in a vacuum, inert or reducing atmosphere.

The moulding 20 or its pre-sintered counterpart is put concentrically about the cylindrical element 10, as shown in FIG. 1, and then sintered under such conditions that the moulding 20 will sufficiently concentrate and contract just to meet the outer periphery of the cylindrical element 10, whereby the moulding 20 forms a bushing 20' integrally engaging the outer periphery of the cylindrical element 10 to produce a roll assembly. Preferable temperature of sintering ranges from 1,250° to 1,500° C., and the moulding 20 is held at the highest temperature for about 10 to 5,000 seconds. When the temperature is below 1,250° C., the moulding 20 will not sufficiently concentrate and will not tightly engage the cylindrical element 10. When higher than 1,500° C., the assembly cannot be exactly shaped. Preferable atmosphere is a vacuum, but may be an inert or reducing atmosphere.

In some cases, there may exist voids or incomplete joints at the interface between the cylindrical element 10 and the bushing 20' due to the oxides or fine roughness on the surface of super hard metals. In order to eliminate such defects, the roll assembly can be further treated in an inert gas such as argon or helium at a high temperature and atmospheric pressure to fill or complete the voids or incomplete joints into a perfectly integral engagement. The condition of temperature as well as pressure varies depending on the sizes of voids or incomplete joints. Preferable temperature ranges from 1,200° to 1,500° C., and preferable pressure is 20 to 2,000 atm. With the temperature below 1,200° C., the metal for binding the hard metal carbide particles will not sufficiently dissolve, and the object of the invention will therefore not be attained, while with the temperature over 1,500° C., the binder metal dissolves too much to maintain the original shape of the roll assembly. When the pressure is lower than 20 atm, the incomplete engagement still remains at the voids, even at the highest temperature of 1,500° C., while pressures higher than 2,000 atm are difficult to obtain and are therefore not suitable for industrial production. Preferably, the assembly is held in a high temperature and high pressure gas for about 60 to 1,000 seconds.

Figure 3:
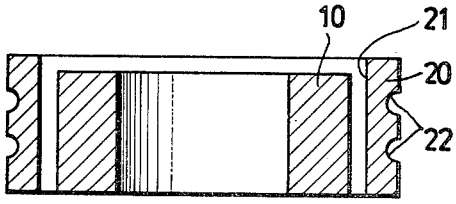
FIGS. 3 and 4 are sectional views illustrating a second embodiment of a process for producing a roll assembly of the invention.
Figure 4:
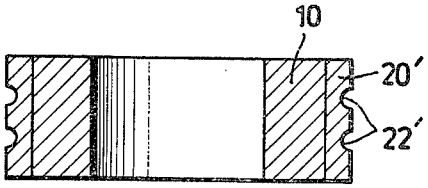

As shown in FIGS. 3 and 4 annular grooves 22 can be previously provided, in the outer periphery of the moulding 20 which after sintering, form corresponding annular grooves 22' for rolling steel wires for example. The outer periphery of the moulding 20, whether presintered or not, can be machined into various other shapes, if desired.

Figure 5:
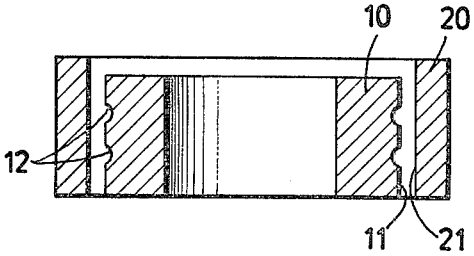
FIGS. 5 through 7 are sectional views showing a third embodiment of a process for producing a roll assembly according to the invention.

Besides said voids or incomplete joints caused by the oxides or roughness on the surface of super hard metal, the cylindrical element 10 might have annular grooves 12 or other cavities in its outer periphery 11 as shown in FIG. 5. In this case, the inner periphery 21 of the moulding 20 need not necessarily be shaped to meet the outer periphery 11, as appears from FIG. 5.

Figure 6:
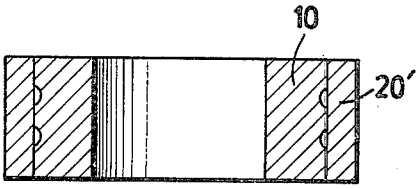
Figure 7:
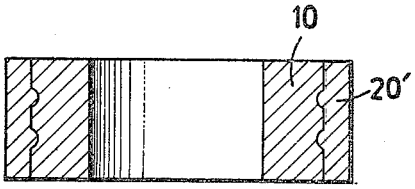

After sintering, the roll assembly still has voids at the interface between the cylindrical element 10 and the bushing 20', as shown in FIG. 6. Therefore, the treatment in an inert gas as mentioned before is also effective in this case. As shown in FIG. 7, the voids are completely filled with a sintered alloy of the bushing 20'.

Though not shown in the drawings, the cylindrical element 10 might have annular ridges or other projections on the outer periphery 11. In this case also, the inner periphery 21 of the moulding 20 need not be complementary to the outer periphery 11 of the cylindrical element 10. After sintering, the roll assembly can be treated in an inert gas as mentioned above.

In order to more clearly illustrate the invention, reference is now to be made to the following Examples, which are only for description rather than a limitation on the invention. Throughout the Examples, percentages are by weight unless otherwise specified.

EXAMPLE 1

There was prepared a sintered cylindrical pillar having a diameter of 50 mm and a height of 40 mm of super hard metal consisting of tungsten carbide and 20% of cobalt. In addition, a powdered mix of tungsten carbide and 20% of cobalt was press-moulded under a pressure of 1.5 t/cm$^2$ to form a cylindrical moulding having an inside diameter of 61 mm, outside diameter of 70 mm and height of 50 mm. The super hard metal pillar was put concentrically in the cylindrical moulding, and heated in a vacuum furnace at 1,340° C. for one hour to obtain a super hard metal pillar assembly having a diameter of 57.4 mm and height of 40 mm.

As a result of examination, the interface between the pillar and moulding showed perfect integration with no defect.

EXAMPLE 2

Instead of a vacuum furnace of Example 1, hydrogen furnace was used for sintering, thereby obtaining a similar pillar assembly, with the same result on examination as in Example 1.

EXAMPLE 3

A sintered super hard metal cylindrical element consisting of tungsten carbide and 18% of cobalt was machined into one having an outside diameter of 140 mm, inside diameter of 60 mm and height of 80 mm. In addition, a powdered mix of tungsten carbide and 15% of cobalt was press-moulded under a pressure of 1.2 t/cm$^2$ to form a cylindrical moulding having an outside diameter of 180 mm, inside diameter of 168 mm and height of 97 mm. The super hard metal cylindrical element was put concentrically in the cylindrical moulding, and heated at 1,360° C. for one hour to obtain a super hard metal cylinder assembly having an outside diameter of 149.7 mm, inside diameter of 59.9 mm and height of 80 mm.

As a result of examination, the interface between the cylindrical element and the moulding showed perfect integration without any defect.

EXAMPLE 4

There was provided a groove with a width of 1 mm and depth of 1 mm in the center of an outer periphery of a sintered super hard metal pillar having a diameter of 60 mm and height of 40 mm consisting of tungsten carbide and 10% of cobalt.

A powdered mix of tungsten carbide and 10% of cobalt was press-moulded under a pressure of 1 t/cm$^2$ to form a cylindrical moulding having an outside diameter of 90 mm, inside diameter of 75 mm and height of 51 mm.

The super hard metal pillar was put concentrically in the cylindrical moulding, and heated in a hydrogen atmosphere at 1,380° C. or one hour to produce a super hard metal pillar assembly having an outside diameter of 71.5 mm and height of 40 mm. As a result of examination, there existed a void caused by said groove at the interface between the pillar and moulding. The assembly was then treated in an argon gas at 1,340° C. under an atmospheric pressure of 200 atm for 10 minutes, whereby the void completely disappeared.

EXAMPLE 5

There was prepared a sintered pillar having a diameter of 50 mm and height of 40 mm of super hard metal consisting of tungsten carbide and 20% of cobalt. In addition, a powdered mix of tungsten carbide and 20% of cobalt was press-moulded under a pressure of 1.5 t/cm$^2$ to form a cylindrical moulding having an inside diameter of 61 mm, outside diameter of 70 mm and height of 50 mm, the outer periphery of which was machined into a suitable shape. The cylindrical moulding was put concentrically about the super hard metal pillar, and heated in a vacuum furnace at 1,340° C. for one hour to obtain a super hard metal pillar assembly having an outside diameter of 57.4 mm and height of 40 mm, the outer periphery of the assembly maintaining the shape corresponding to that of the cylindrical moulding. As a result of examination, the interface between the pillar and moulding showed perfect engagement with no defect.

According to the invention as described hereinbefore in detail, a moulding of super hard metal materials can be securely bushed about a super hard metal roll or the like by utilizing the contraction upon sintering the moulding. The invention, therefore, is highly effective for the reproduction of worn-out roll, pillar, shaft or the like of super hard metal, thereby making it possible to save the limited resources such as tungsten and cobalt. Further the reproduction can be conducted by a ready process at a low cost.

The invention can be applied not only to a moulding having the same composition as a roll, pillar or the like to be bushed, but also to a moulding of different composition.

We claim:

1. A process of producing a cemented carbide roll assembly comprising:

moulding a powdered mix of cemented carbide-forming materials into a hollow cylindrical moulding, placing the hollow cylindrical moulding concentrically about a cylindrical cemented carbide element in a manner such as to provide a space between the inner periphery of the hollow cylindrical moulding and the outer periphery of the cylindrical cemented carbide element, sintering the resultant assembly at a temperature from 1,250° to 1,500° C., thereby contracting the hollow cylindrical moulding and generating a liquid phase to effect integral engagement between the hollow cylindrical moulding and the cylindrical cemented carbide element, and heat-treating the resultant roll assembly in an inert gas at a temperature from 1,200° to 1,500° C. under a pressure of 20 to 2,000 atm so as to eliminate voids between the sintered moulding and the cylindrical cemented carbide element.

2. A process as claimed in claim 1, wherein the hollow cylindrical moulding is pre-sintered before being placed about the cylindrical cemented carbide element.

3. A process as claimed in claim 2, wherein pre-sintering is carried out at a temperature from 200° to 1,000° C.

4. A process as claimed in claim 1, wherein the moulding step is carried out under a pressure of 10 to 10,000 kg/cm$^2$.

5. A process as claimed in claim 1, wherein the powdered mix of cemented carbide-forming materials consists of 50 to 99.9% by weight of at least one member selected from the group consisting of tungsten carbide, titanium carbide, tantalum carbide, niobium carbide, molybdenum carbide, chromium carbide, hafnium carbide and vanadium carbide, the remainder of said powdered mix being at least one binder metal selected from the group consisting of iron, nickel, cobalt, chromium, copper, silver and gold.

* * * * *